US011013330B2

(12) United States Patent
Liu et al.

(10) Patent No.: US 11,013,330 B2
(45) Date of Patent: May 25, 2021

(54) SINGLE POWER DUAL-DIRECTIONAL ACTUATOR SYSTEM FOR MOVEMENT OF A FURNITURE PIECE STRUCTURE IN A RECTILINEAR AND BALANCED MANNER

(71) Applicant: HHC HANGZHOU CORPORATION, Changzhou (CN)

(72) Inventors: Chih Hsiung Liu, Benoni (ZA); Mei Jun Xu, Jiujiang (CN)

(73) Assignee: HHC CHANGZHOU CORPORATION, Changzhou (CN)

( * ) Notice: Subject to any disclaimer, the term of this patent is extended or adjusted under 35 U.S.C. 154(b) by 191 days.

(21) Appl. No.: 16/255,849

(22) Filed: Jan. 24, 2019

(65) Prior Publication Data

US 2020/0237101 A1 Jul. 30, 2020

(51) Int. Cl.

| | |
|---|---|
| ***A47C 7/46*** | (2006.01) |
| ***A47C 19/02*** | (2006.01) |
| ***A61G 7/07*** | (2006.01) |

(52) U.S. Cl.

CPC ..... *A47C 7/462* (2013.01); *A47C 19/02* (2013.01); *A61G 7/07* (2013.01)

(58) Field of Classification Search

CPC ..... A47C 7/467; A47C 19/02; A47C 7/46; A47C 7/462; A61G 7/07; B66F 7/0691; B66F 7/08; B66F 7/06

USPC ..... 5/657

See application file for complete search history.

(56) References Cited

U.S. PATENT DOCUMENTS 6,634,462 B2 * 10/2003 Byeong-Ho ..... B66F 7/08 187/269

2015/0067964 A1 * 3/2015 Xu ..... A61G 7/012 5/616

FOREIGN PATENT DOCUMENTS

DE 4326438 A1 * 3/1994 ..... B66F 7/0691

* cited by examiner

*Primary Examiner* — Nicholas F Polito

*Assistant Examiner* — James T Coble

(74) *Attorney, Agent, or Firm* — Law Offices of Steven W. Weinrieb

(57) ABSTRACT

A powered actuator system for moving a lumbar support bar of a furniture piece is disclosed and comprises a single dual-directional powered actuator mounted upon a foundation base with respect to which the lumbar support bar is to be moved between fully extended and fully retracted positions, as well as a multiplicity of intermediate positions. The single dual-directional powered actuator is operatively connected to a first end portion of the lumbar support bar by means of a first main lifting link, while a synchronization bar operatively interconnects the first main lifting link with a second main lifting link operatively connected to a second end portion of the lumbar support bar. In this manner, the lumbar support bar is moved between its extended and retracted positions in a rectilinear and balanced mode.

10 Claims, 2 Drawing Sheets

SINGLE POWER DUAL-DIRECTIONAL ACTUATOR SYSTEM FOR MOVEMENT OF A FURNITURE PIECE STRUCTURE IN A RECTILINEAR AND BALANCED MANNER

FIELD OF THE INVENTION

The present invention relates to powered mechanisms, such as, for example, a powered actuator, and more particularly a single powered actuator system which can be utilized in connection with various furniture pieces such as, for example, powered chairs, powered beds, and the like, in order to actuate a furniture piece structure in a rectilinear and balanced manner.

BACKGROUND OF THE INVENTION

The prior art is replete with powered mechanisms which are often utilized in conjunction with powered chairs or powered beds, or other similar furniture pieces, so as to activate a particular section or segment of the chair or bed. For example, in connection with powered chairs, powered actuators are conventionally employed to incline the seat-back of the chair, or to extend the footrest of the chair. In order to actuate elongated structural members of the furniture piece, such as, for example, a lumbar support bar, a plurality of actuators are usually attached to spaced sections or segments of the lumbar support bar and, of course, they need to be actuated simultaneously, and to the same degree, in order to ensure that the lumbar support bar is moved in a particular direction, and more importantly, in a structurally balanced manner such that, for example, one end of the lumbar support bar is not extended or retracted to a greater degree than the opposite end of the lumbar support bar. The use of multiple actuators, however, significantly increases the cost of the furniture piece. In addition, as can be seen in FIG. 1, one known type of powered actuator system, as generally indicated by the reference character 10, actually causes the link element 12, connecting the powered actuator 14 to the lumbar support bar 16, to move in a substantially arcuate manner, as illustrated schematically at different positions along an arcuate path of movement, whereby the lumbar support bar 16 does not always act directly upon the lumbar region of the human spine but, in fact, during its arcuate movement, acts upon other regions of the spine adjacent to the lumbar region of the spine. These impact forces upon the other regions of the spine adjacent to the lumbar region of the spine can actually cause discomfort problems as opposed to the desired objective of properly supporting the lumbar region of the spine when, for example, the person is lying in a supine position upon a bed.

A need therefore exists in the art for a new and improved single powered actuator system which can be utilized in connection with various furniture pieces such as, for example, powered chairs, powered beds, and the like. Another need exists in the art for a new and improved single powered actuator system which can be utilized in connection with a lumbar support bar. An additional need exists in the art for a new and improved single powered actuator system which can be utilized in connection with a lumbar support bar which may be incorporated within a furniture piece such as, for example, a lounger chair or a bed. A further need exists in the art for a new and improved single powered actuator system which can be utilized in connection with a lumbar support bar which may be incorporated within a furniture piece such as, for example, a lounger chair or a bed, and wherein the actuator system will move the lumbar support bar structure in a rectilinear and balanced manner. A still further need exists in the art for a new and improved single powered actuator system which can be utilized in connection with a lumbar support bar which may be incorporated within a furniture piece such as, for example, a lounger chair or a bed, and wherein the actuator system will move the lumbar support bar structure in a rectilinear and balanced manner such that the lumbar support bar only impacts, and thereby properly supports, the lumbar region of the human spine.

OVERALL OBJECTIVES OF THE INVENTION

An overall objective of the present invention is to provide a new and improved single powered actuator system which can be utilized in connection with various furniture pieces such as, for example, powered chairs, powered beds, and the like. Another overall objective of the present invention is to provide a new and improved single powered actuator system which can be utilized in connection with a lumbar support bar. An additional overall objective of the present invention is to provide a new and improved single powered actuator system which can be utilized in connection with a lumbar support bar which may be incorporated within a furniture piece such as, for example, a lounger chair or a bed. A further overall objective of the present invention is to provide a new and improved single powered actuator system which can be utilized in connection with a lumbar support bar which may be incorporated within a furniture piece such as, for example, a lounger chair or a bed, and wherein the actuator system will move the lumbar support bar structure in a rectilinear and balanced manner. A still further overall objective of the present invention is to provide a new and improved single powered actuator system which can be utilized in connection with a lumbar support bar which may be incorporated within a furniture piece such as, for example, a lounger chair or a bed, and wherein the actuator system will move the lumbar support bar structure in a rectilinear and balanced manner such that the lumbar support bar only impacts, and thereby properly supports, the lumbar region of the human spine.

SUMMARY OF THE INVENTION

The foregoing and other objectives are achieved in accordance with a single powered actuator system which has been developed in accordance with the teachings and principles of the present invention, and which comprises a single powered actuator operatively connected to opposite ends of a lumbar support bar. The single powered actuator comprises a piston-cylinder type actuator wherein the cylinder end of the single powered actuator is pivotally mounted to a mounting bracket fixedly secured to the undersurface portion of a foundation deck, while the piston end of the single powered actuator is connected to a first, transversely oriented cross-pin which is slidably disposed within a first longitudinally extending slot defined within a first, forwardly disposed actuator mounting bracket. A first main lifting link is operatively connected at a first end portion thereof to the first, transversely oriented cross-pin, while a second end portion of the first main lifting link is operatively connected to a first end portion of the lumbar support bar. In a similar manner, a second, transversely oriented cross-pin is slidably disposed within a second longitudinally extending slot which is defined within a second, rearwardly disposed actuator mounting bracket, and a second main lifting link is operatively connected at a first end portion thereof to the second, transversely oriented cross-pin while a second end portion of the second main lifting link is operatively connected to a second end portion of the lumbar support bar. In addition, a synchronization link is operatively connected at its opposite end portions to the first and second transversely oriented cross-pins respectively disposed within the first and second longitudinally extending slots respectively defined within the first and second forwardly and rearwardly disposed actuator mounting brackets.

Accordingly, when the single powered actuator is actuated such that the piston portion of the cylinder-piston actuator is extended, the extended piston will cause the first, transversely oriented cross-pin to move forwardly within the first, longitudinally extending slot defined within the first, forwardly disposed actuator mounting bracket so as to cause the first main lifting link to pivot upwardly so as to effectively elevate the forward portion of the lumbar support bar to, for example, a fully extended position. However, as a result of the connection of the first, transversely oriented cross-pin, disposed within the first, longitudinally extending slot defined within the first, forwardly disposed actuator mounting bracket, being operatively connected to the second, transversely oriented cross-pin, disposed within the second, longitudinally extending slot defined within the second, rearwardly disposed actuator mounting bracket by means of the synchronization link, the second, transversely oriented cross-pin, and the second main lifting link, operatively connected to the second end portion of the lumbar support bar, will undergo precisely the same movements as those of the first, transversely oriented cross-pin and the first main lifting link so as to effectively elevate the second opposite end portion of the lumbar support bar to its fully tended position in a simultaneous, rectilinear, and balanced mode. It is to be appreciated that when the powered actuator is actuated in a reverse mode, wherein the piston end portion of the powered actuator is retracted, then the lumbar support bar is returned to its fully retracted position. It is to be further understood and appreciated that the powered actuator can be controlled such that the lumbar support bar can be elevated to a multiplicity of positions intermediate the fully extended and fully retracted positions.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENT

Figure 2:
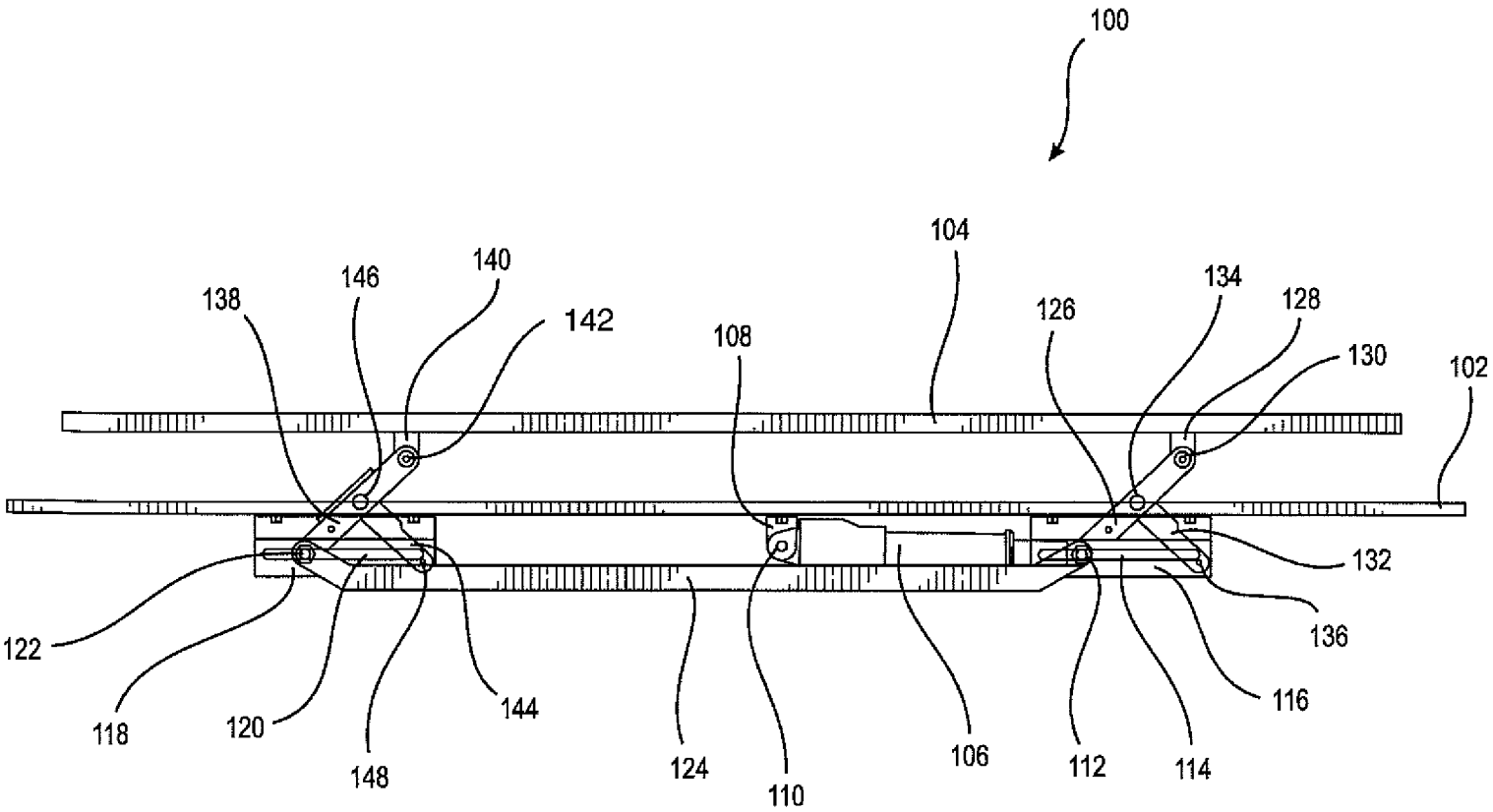
FIG. 2 is a side elevational view of the new and improved single powered lumbar actuator system as developed in accordance with the principles and teachings of the present invention.

Referring now the drawings, and more particularly to FIG. 2 thereof, the new and improved powered lumbar actuator system, which is to be utilized in conjunction with a furniture piece such as, for example, a lounge chair or a bed, is disclosed and is generally indicated by the reference character 100. The furniture piece will include a foundation base or deck 102 upon which the independent powered lumbar mechanism 100 will be fixedly mounted. More particularly, it is seen that the independent powered lumbar mechanism 100 comprises a lumbar support bar 104 to which a lumbar support, cushion, pad, or the like, not shown, is adapted to be attached. As is well known, a lumbar support is adapted to be movable between a fully extended position and a fully retracted position, as well as multiple intermediate positions between the fully extended position and the fully retracted position, so as to comfortably support the lumbar region of a person whether they are disposed in a sitting position or a supine position. Accordingly, in order to move the lumbar support bar 104 between the various extended or retracted positions, including positions intermediate the fully extended and fully retracted positions, a single dual-directional powered piston-cylinder actuator 106 is provided and has its first or cylinder end pivotally connected to a mounting bracket 108 by means of a pivot pin 110, and it is seen that the mounting bracket 108 is fixedly mounted upon the underside of the foundation base or deck 102 by means of any suitable fastener. The opposite, second or piston end of the powered piston-cylinder actuator 106 is provided with a first transversely oriented cross-pin 112 which is slidably disposed within a first, longitudinally extending slot 114 that is defined within a first, forwardly disposed actuator mounting bracket 116 which is likewise fixedly mounted upon the underside of the foundation base or deck 102 by means of any suitable fastener. Still further, it is seen that a second, rearwardly disposed actuator mounting bracket 118 is likewise fixedly mounted upon the underside of the foundation base or deck 102 by means of any suitable fastener, and in a manner similar to that of the first, forwardly disposed actuator mounting bracket 116, the second rearwardly disposed actuator mounting bracket 118 is provided with a second longitudinally extending slot 120 within which a second transversely oriented cross-pin 122 is slidably disposed. Lastly, it is seen that a longitudinally extending synchronization link 124 has its opposite ends connected to the first and second transversely oriented cross-pins 112, 122.

With reference continuing to be made to FIG. 2, it is further seen that a first main lifting link 126 has a first end thereof pivotally connected to the first transversely oriented cross-pin 112, while a second opposite end of the first main lifting link 126 is pivotally connected to a first, forwardly disposed lumbar mounting bracket 128, by means of a pivot pin 130, wherein the first forwardly disposed lumbar mounting bracket 128 is fixedly mounted upon a forward underside portion of the lumbar support bar 104. In addition, it is also seen that a first supporting link 132 has a first end thereof pivotally connected to an intermediate portion of the first main lifting link 126 by means of a pivot pin 134, while a second, opposite end of the first supporting link 132 is pivotally connected to the first, forwardly disposed actuator mounting bracket 116 by means of another pivot pin 136. In a similar manner, it is seen that a second main lifting link 138 has a first end thereof pivotally connected to the second transversely oriented cross-pin 122, while a second opposite end of the second main lifting link 138 is pivotally connected to a second, rearwardly disposed lumbar mounting bracket 140, by means of a pivot pin 142, wherein the second, rearwardly disposed lumbar mounting bracket 140 is fixedly mounted upon a rearward underside portion of the lumbar support bar 104. In addition, it is also seen that a second supporting link 144 has a first end thereof pivotally connected to an intermediate portion of the second main lifting link 138 by means of a pivot pin 146, while a second, opposite end of the second supporting link 144 is pivotally connected to the second, rearwardly disposed actuator mounting bracket 118 by means of another pivot pin 148.

Figure 1:
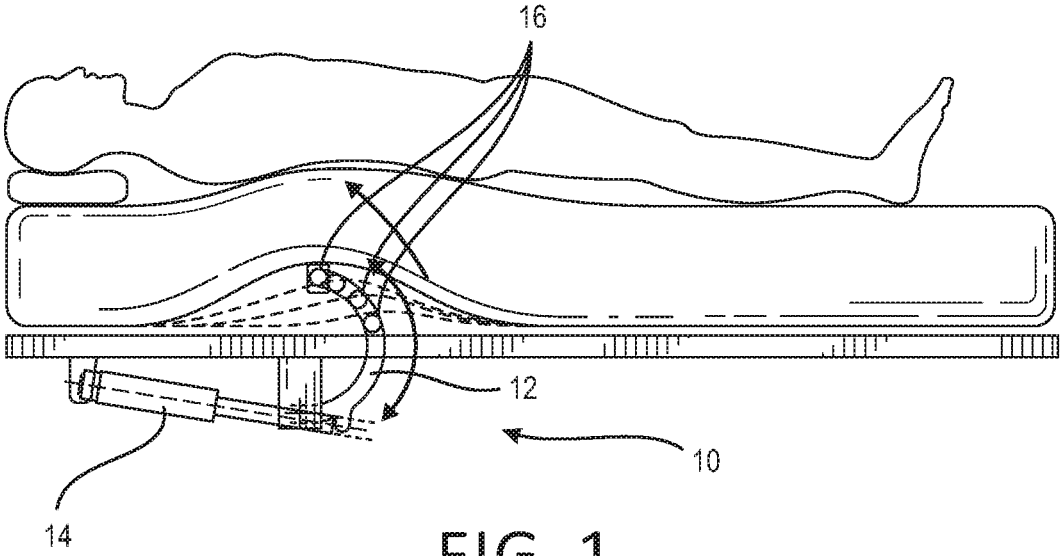
FIG. 1 (PRIOR ART)
FIG. 1 is a schematic side elevational view showing a conventional PRIOR ART actuator system operatively connected to a lumbar support bar as used within a bed.
Figure 3:
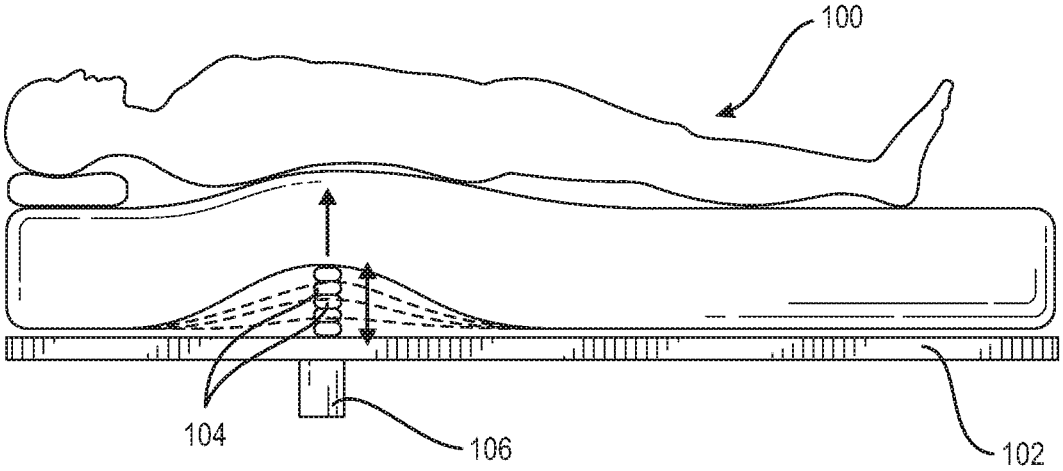
FIG. 3 is a schematic side elevational view, similar to that of FIG. 1, showing, however, the use of the new and improved single powered actuator system of the present invention as used in a bed.

Having described substantially all of the structural components comprising the new and improved independent powered lumbar mechanism 100, a brief description of its operation will now be described. When the lumbar support bar 104 is to be extended from, for example, an initially fully retracted position, the powered piston cylinder actuator 106 is activated such that the piston end of the piston-cylinder powered piston-cylinder actuator 106 will be extended toward the right as viewed in FIG. 2. Accordingly, the piston end of the piston-cylinder powered piston-cylinder actuator 106 will cause the transversely oriented cross-pin 112 to move within the longitudinally extending slot 114 that is defined within the first, forwardly disposed actuator mounting bracket 116 so as to, in turn, effectively cause the first main lifting link 126 to begin to rise as permitted by means of the first support link 132 which is also pivotally connected to the first, forwardly disposed actuator mounting bracket 116. As the first main lifting link 126 begins to rise, it causes the forward portion of the lumbar support bar 104 to move outwardly from its fully retracted position toward its fully extended position. At the same time, in view of the fact that the synchronization link 124 is connected at its opposite ends to both the first transversely oriented cross-pin 112 and the second transversely oriented cross-pin 122, the synchronization link 124 will cause the second transversely oriented cross-pin 122 to likewise move toward the right, as viewed within FIG. 2, and within its longitudinally extending slot 120 defined within the second, rearwardly disposed actuator mounting bracket 118 whereby the slidable movement of the second transversely oriented cross-pin 122 within its longitudinally extending slot 120 will cause the second main lifting link 138 to begin to rise as permitted by means of the second support link 144 which is also pivotally connected to the second, reawardly disposed actuator mounting bracket 118. Therefore, as the second main lifting link 138 begins to rise, it causes the rearward portion of the lumbar support bar 104 to move outwardly from its fully retracted position toward its fully extended position in an identically synchronous manner of movement as the forward portion of the lumbar support bar 104 was caused to move by means of the movement of the aforenoted the first main lifting link 126 and the first support link 132. Therefore, by means of a single piston-cylinder actuator 106, the lumbar support bar 104 is able to be moved in a structurally balanced manner so as to achieve precise movement of the lumbar support bar 104 to its fully extended and fully retracted positions as well as any one of a multitude of positions intermediate the fully extended and fully retracted positions as determined by means of the degree to which the piston-cylinder actuator 106 is in fact actuated. More particularly, as schematically illustrated within FIG. 3, it is also clear that the new and improved single powered actuator system of the present invention is able to extend and retract the lumbar support bar 104 in a rectilinear manner such that the lumbar support bar 104 impacts or directly engages the lumbar region of the human spine so as to provide proper or desired support therefor.

Obviously, many variations and modifications of the present invention are possible in light of the above teachings. It is therefore to be understood that within the scope of the appended claims, the present invention may be practiced otherwise than as specifically described herein.

What is claimed is:

1. A powered actuator system for moving a segment of a furniture piece with respect to a foundation base, comprising:

a foundation base;

a segment of a furniture piece adapted to be moved between an extended position and a retracted position with respect to said foundation base;

a single dual-directional powered actuator having a first end thereof mounted upon said foundation base;

a first main lifting link operatively connected at a first end portion thereof to a first end portion of said segment of the furniture piece, while a second end portion of said first main lifting link is connected to a second end portion of said single dual-directional powered actuator; and a second main lifting link operatively connected at a first end portion thereof to a second end portion of said segment of the furniture piece, while a second end portion thereof is operatively connected to a synchronization link which operatively interconnects said second end portions of said first and second main lifting links and which is also operatively connected to said second end portion of said single dual-directional powered actuator, and wherein said first end portion of said single-dual directional powered actuator, connected to said foundation base, is interposed between said first and second main lifting links, whereby when said single dual-directional powered actuator is actuated, said second end portion of said single dual-directional powered actuator will cause said first main lifting link to move said first end portion of said segment of the furniture piece to a first extended position while said second main lifting link will simultaneously be caused to move said second end portion of said segment of the furniture piece to a second extended position which corresponds to said first extended position to which said first end portion of said segment of the furniture piece was moved by said first main lining link, as a result of said first and second main lifting links being connected together by said synchronization link, such that said segment of the furniture piece is moved between extended and retracted positions in a rectilinear and balanced mode.

2. The powered actuator system as set forth in claim 1, wherein:

said segment of the furniture piece comprises a lumbar support bar.

3. The powered actuator system as set forth in claim 2, wherein:

wherein said lumbar support bar can be used upon a lounger chair in order to properly support the lumbar region of a human spine.

4. The powered actuator system as set forth in claim 2, wherein:

wherein said lumbar support bar can be used upon a bed in order to properly support the lumbar region of a human spine.

5. The powered actuator system as set forth in claim 1, wherein:

said single dual-directional powered actuator comprises a piston-cylinder actuator.

6. The powered actuator system as set forth in claim 5, wherein:

said first end of said single dual-directional powered actuator comprises a cylinder portion of said piston-cylinder actuator; and said second end of said single dual-directional powered actuator comprises a piston portion of said piston-cylinder actuator.

7. The powered actuator system as set forth in claim 1, wherein:

said first end of said single dual-directional powered actuator is mounted upon an undersurface portion of said foundation base.

8. The powered actuator system as set forth in claim 1, further comprising:

a first, forwardly disposed actuator mounting bracket mounted upon said foundation base;

a first longitudinally extending slot defined within said first, forwardly disposed actuator mounting bracket; and a first transversely oriented cross-pin connected to said second end of said single, dual-directional powered actuator, connected to said first end of said first main lifting link, and slidably disposed within said first longitudinally extending slot defined within said first, forwardly disposed actuator mounting bracket.

9. The powered actuator system as set forth in claim 8, further comprising:

a second, rearwardly disposed actuator mounting bracket mounted upon said foundation base;

a second longitudinally extending slot defined within said second, rearwardly disposed actuator mounting bracket; and a second transversely oriented cross-pin connected to said second end of said second main lifting link, and slidably disposed within said second longitudinally extending slot defined within said second, rearwardly disposed actuator mounting bracket.

10. The powered actuator system as set forth in claim 9, wherein:

said first and second opposite ends of said synchronization link are operatively connected to said first and second transversely oriented cross-pins respectively slidably disposed within said first and second longitudinally extending slots respectively defined within said first and second forwardly and rearwardly disposed actuator mounting brackets.

* * * * *